US006185911B1

(12) United States Patent
Hähnel et al.

(10) Patent No.: US 6,185,911 B1
(45) Date of Patent: Feb. 13, 2001

(54) METHOD FOR FILLING A TWO-CHAMBER-TUBE AND DEVICE FOR CARRYING OUT THE METHOD

(75) Inventors: Bernd Hähnel, Stutensee; Herbert Frey, Weingarten, both of (DE)

(73) Assignee: IWK Verpackunsgstechnik GmbH, Stutensee (DE)

( * ) Notice: Under 35 U.S.C. 154(b), the term of this patent shall be extended for 0 days.

(21) Appl. No.: 09/220,379

(22) Filed: Dec. 24, 1998

(30) Foreign Application Priority Data

Feb. 28, 1998 (DE) ..... 198 08 649

(51) Int. Cl.[7] ..... B65B 3/16

(52) U.S. Cl. ..... 53/452; 53/237; 53/263; 53/474

(58) Field of Search ..... 53/424, 452, 456, 53/410, 237, 157, 156, 155, 158, 539, 263; 222/94

(56) References Cited

U.S. PATENT DOCUMENTS 1,676,734 * 7/1928 Hopkins .
3,390,507 * 7/1968 Repko ..... 53/474 X
4,811,549 * 3/1989 Usami et al. ..... 53/474 X
5,076,464 * 12/1991 Simon ..... 220/530
5,714,023 * 2/1998 Redfern ..... 156/69
5,775,386 * 7/1998 Connan ..... 53/474 X

FOREIGN PATENT DOCUMENTS 195 22 169 * 1/1997 (DE) .
961 154 * 5/1950 (FR) .
WO97 30898 * 8/1997 (WO) .
WO97 47522 * 12/1997 (WO) .
WO98 19929 * 5/1998 (WO) .
WO98 24705 * 6/1998 (WO) .

* cited by examiner

*Primary Examiner*—James F. Coan
(74) *Attorney, Agent, or Firm*—Paul Vincent

(57) ABSTRACT

The invention concerns a method for filling a two chamber tube made from plastic having a substantially circular cross section and a separation wall made from plastic and extending between two substantially diametrically opposed connecting points of the separation wall and having a length in excess of the diameter of the tube to form, together with the wall of the tube, the two chambers. A filling nozzle is inserted into each chamber for introducing the filling product into the tube and the tube is sealed after removal of the filling nozzles. In order to guarantee reliable filling of the two chamber tube, the separation wall is attached, prior to introduction of the filling nozzles, to the inside tube wall at its end regions bordering the connecting points in such a fashion that the length of the middle region remaining between the two end regions corresponds substantially to the diameter of the tube.

13 Claims, 3 Drawing Sheets

METHOD FOR FILLING A TWO-CHAMBER-TUBE AND DEVICE FOR CARRYING OUT THE METHOD

This application claims Paris Convention Priority of German patent application number 198 08 649.0 filed Feb. 28, 1998 the complete disclosure of which is hereby incorporated by reference.

BACKGROUND OF THE INVENTION

The invention concerns a method for filling a two chamber tube made from plastic and having a substantially circular cross section with a separation wall made from plastic extending between two substantially diametrically opposed connection points of the tube wall, and having a length in excess of the diameter of the tube and which, together with the walls of the tube, defines the two chambers, wherein a filling nozzle is inserted into each chamber for introduction of a filling product, with the tube being sealed after the filling nozzles have been removed. The invention also concerns an apparatus for carrying out the method having a filling unit and a downstream sealing unit for sealing the filled tubes.

Two chamber tubes made from plastic have been known in the art for some time and have the advantage of being able to accept two differing materials in one tube without having the materials come into contact with each other as is e.g. necessary with a two-component glue. A two chamber tube is manufactured from an initially flat multi-layered structure, wherein a plastic layer forming the separation wall is disposed between an upper and a lower tube wall layer. The tube is then subsequently erected to an approximately circular shape, wherein the separation wall, which should diametrically extend within the tube, is significantly longer than the diameter of the tube. In consequence of this excess length, the separation wall does not extend in a linear fashion, rather is curved with unpredictable shape.

A filling nozzle must be introduced into each of the two chambers to fill same. It has turned out that the uncontrollable position of the separation wall often interferes with introduction of the filling nozzles or causes both filling nozzles to be inserted into the same chamber so that the filling process has to be interrupted.

In order to prevent improper filling of the two chamber tube one has attempted to monitor the position of the separation wall prior to the filling procedure using video techniques in order to screen tubes having an undesirable wall position. This process is however difficult from a technical point of view and therefore expensive and leads to a very high fraction of rejected tubes which can not be filled.

It is therefore the underlying purpose of the invention to create a method of the above mentioned kind with which two chamber tubes can be filled in a reliable fashion as well as an apparatus with which the method can be carried out in a simple and economical fashion.

SUMMARY OF THE INVENTION

With regard to the method, the above mentioned purpose is achieved in that the separation wall is attached, at the end regions bordering the connection points, to the inner side of the tube wall prior to introduction of the filling nozzles in such a fashion that the length of the remaining middle region between the end regions corresponds substantially to the diameter of the tube.

In accordance with the invention, a tightening of the separation wall is thereby effected. The end regions of the separation wall, in consequence of their attachment to the walls of the tube, substantially follow the contours thereof and the middle region of the separation wall between the end regions extends substantially linearly in a diametric fashion relative to the circular shaped cross section of the tube. In this manner, a defined separation wall dependence is effected so that the filling nozzles can be introduced with high precision into the chambers defined by the tube walls and the separation wall. Hindrance of the filling procedure by an unchecked position of the separation wall is thereby prevented.

In order to guarantee that the end regions seat evenly on the inner side of the tube wall, a preferred embodiment of the invention provides that the end regions of the separation wall are connected over a large area to the tube wall.

An improvement of the invention provides that the end regions of the separation wall are welded to the surface of the tube wall. The welding can thereby be carried out in such a fashion that the end regions can be detached from the tube walls after the tube is filled. Instead of surface weldment, other kinds of connections, such as gluing can be used.

In order to advantageously achieve a large area welding connection between the tube wall and the separation wall a preferred embodiment of the invention provides that a heated shaping head be introduced into the tube to tension the separation wall and hold the end regions of the separation wall in a predetermined aligned fashion. Pressing jaws are then driven, from outside of the tube, against the sections of the shaping head holding the end regions of the separation wall so that the tube wall and the associated end regions of the separation wall are disposed between the shaping head and the associated pressing jaw. Heating via the shaping head leads to connective bonding between the separation wall at the end regions thereof and the inner surface of the tube wall.

One must avoid damage to the central region of the separation wall during the connection procedure. Towards this end the shaping head preferentially has a groove in which the central region of the separation wall can be accepted substantially without contact.

When the separation wall is only surface connected to the tube walls, only a small amount of heat must be introduced by the shaping head. The outer pressing jaws can thereby be neither heated nor cooled.

The above mentioned purpose is achieved with regard to an apparatus in that the filling unit comprises an upstream shaping unit having a heated shaping head which can be introduced into the tube to hold, in an aligned manner, the end regions of the separation wall with the assistance of seating surfaces and with pressing jaws disposed on the outer side of the tube which can be driven against the seating surfaces of the shaping head. It is thereby possible to directly provide the above mentioned alignment and tensioning of the separation wall within the tube filling machine as an additional processing step immediately preceding the actual filling process so that increases in time and technical effort can be kept to a minimum.

Since the end regions of the separation wall which are to be connected to the tube wall are disposed substantially diametrically across from each other, the seating surfaces are preferentially formed at opposite sides of the shaping head. The groove which accepts the middle region of the separation wall without contact extends between the two seating surfaces within the shaping head to thereby subdivide the shaping head into two introduction sections.

In order to simplify introduction of the shaping head into the tube and, in particular, reliably guarantee capture of the separation wall within the groove, a further improvement of the invention provides that the introduction sections of the shaping head each have guiding surfaces on the introduction sides facing the tube. This can e.g. be achieved if the guiding surfaces are tilted with respect to each other in such a fashion that the introduction sections have a shape tapering down towards their lower free end.

The seating surfaces are normally parallel to each other. The groove connecting the seating surfaces can extend perpendicular thereto. It has however turned out to be advantageous when the groove extends at an angle relative to the seating surfaces, whereby an acute angle between the corresponding seating surface and the associated section of the groove on the order of magnitude of approximately 60° to 70° has turned out to be useful. This causes the middle region of the separation wall to extend substantially diagonally within the groove with only point contact with the wall of the groove in the vicinity of the transition to the seating surfaces. In order to prevent the middle region of the separation wall within the groove from seating on a wall of the groove or the sides thereof, the sides of the groove can each have a recess extending along the entire groove length or at least along the middle region thereof so that the groove wall has as large a separation as possible from the middle region of the separation wall.

Further details and features of the invention can be extracted from the following description of an embodiment with reference to the drawing.

DESCRIPTION OF THE PREFERRED EMBODIMENT

Figure 1:
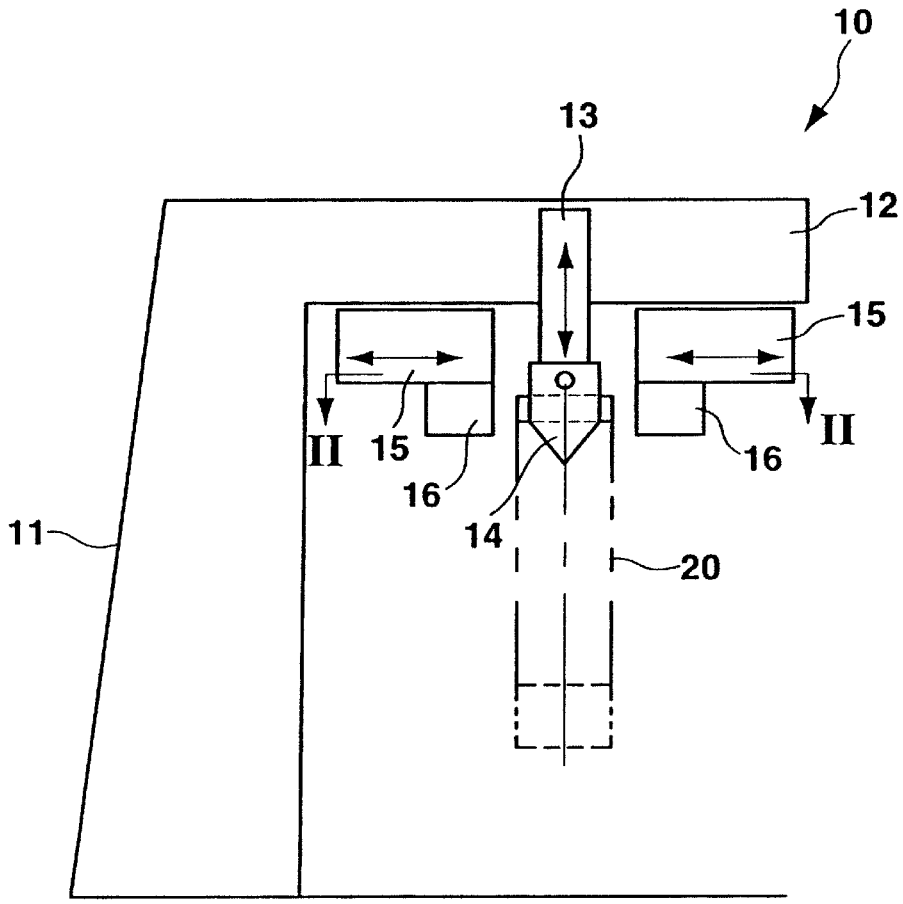
FIG. 1 shows a schematic side view of a shaping unit.
Figure 2:
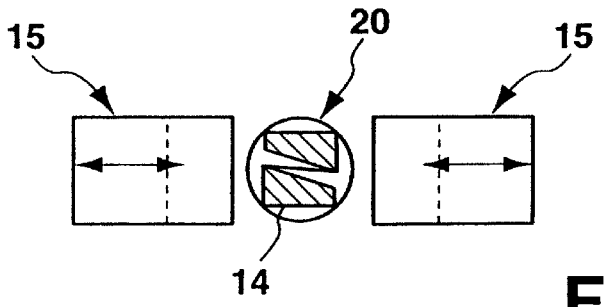
FIG. 2 shows the cut II—II of FIG. 1.

A shaping unit 10, shown in FIG. 1, can be installed into a tube filling machine. The shaping unit 10 comprises a vertical stand 11 which maps into a horizontal transverse support 12 at its upper end. A shaping head 14 is borne via a vertically displaceable mounting 13 on the transverse support 12 for introduction into the open upper end of a tube 20 (indicated as dashed lines). The shaping head 14 has associated pressing jaws 16 borne at opposite sides in horizontally displaceable mountings 15 which, when the shaping head 14 is inserted, seat at the outer side of the tube 20 to press the tube 20 against the shaping head 14 (see FIG. 2).

Figure 4:
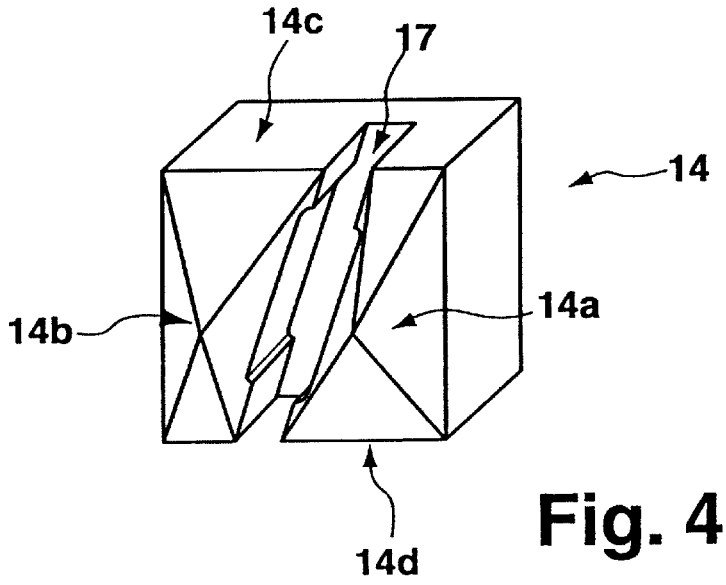
FIG. 4 shows a perspective front view of the shaping head.
Figure 5:
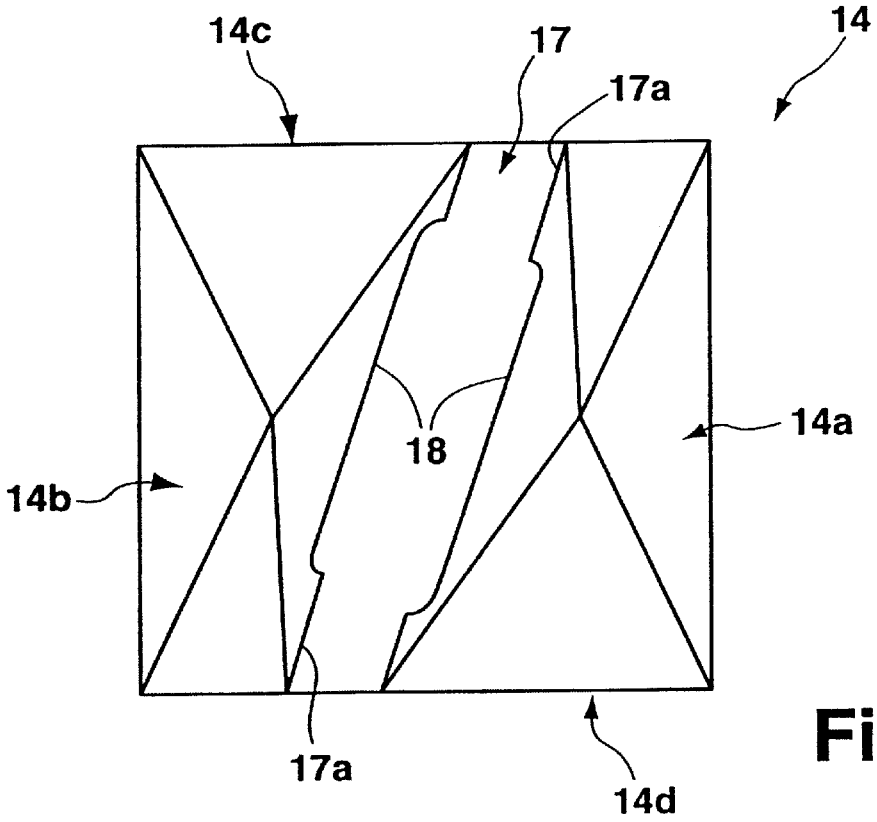
FIG. 5 shows an enlarged front view of the shaping head.

The shaping head 14 is shown in detail in FIGS. 4 and 5. The shaping head 14 has a diagonal groove 17 at its front introductory side initially lowered into the tube which extends through the entire height of the shaping head 14 to thereby subdivide same into two finger-like introduction sections 14*a* and 14*b* protruding towards the introductory side. The introduction sections 14*a* and 14*b* each have guiding surfaces at their outer sides facing the introduction direction which are tilted with respect to each other to impart a tapered pyramid-like shape to the introduction sections.

Seating surfaces 14*c* and 14*d*, whose function will be explained later, are formed on the opposite side surfaces of the shaping head 14 between which the groove 17 extends. The shaping head 14 can be warmed or heated by a heating unit (not shown).

Each side 17*a* of the groove 17 has a large area recess 18 extending over a large fraction of the length of the groove, in particular in the central region thereof, to widen a portion of the groove.

Figure 3A:
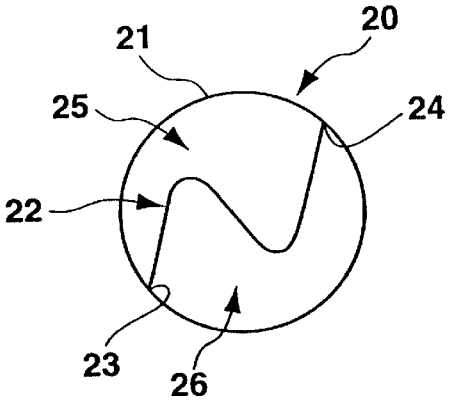
FIG. 3*a* shows a first phase for attachment of the end sections of the separation wall.

FIG. 3*a* shows a plan view of a conventional two chamber tube 20 made from plastic. The tube wall 21 is erected to a circular shape, wherein a separation wall made from a plastic sheet extends between two diametrically opposed connecting points 23 and 24 of the tube wall 21 to subdivide the inner region of the tube into two independent chambers 25 and 26. The separation wall 22 has a length significantly in excess of the diameter of the tube 20 so that, in the example shown, it travels in an S-shaped fashion between the two connecting points 23 and 24.

Figure 3B:
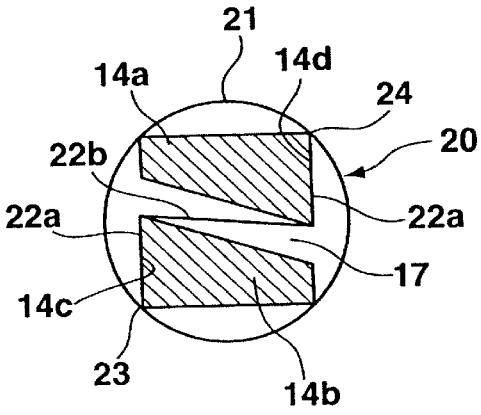
FIG. 3*b* shows a second phase for attachment of the end sections of the separation wall.

In order to tension and align the separation wall 22 in a predetermined fashion, the introductory end of the shaping head 14 is introduced from the upper direction into the tube 20, wherein the introduction section 14*a* is disposed in the chamber 25 and the introduction section 14*b* in the chamber 26. The separation wall 22 is thereby guided into the groove 14 via the guiding surfaces formed by the introduction sides of the shaping head 14 so that the end regions 22*a* of the separation wall 22 seat on the seating surfaces 14*c* and 14*d* disposed at opposite sides of the shaping head 14, whereas the central region 22*b* of the separation wall 22 extends diagonally in a longitudinal direction of the groove 17 therein due to the tilted nature of the groove 17. This situation is shown in FIG. 3*b*. The end regions 22*a* of the separation wall 22 are each thereby held in a substantially straight and mutually parallel manner.

Figure 3C:
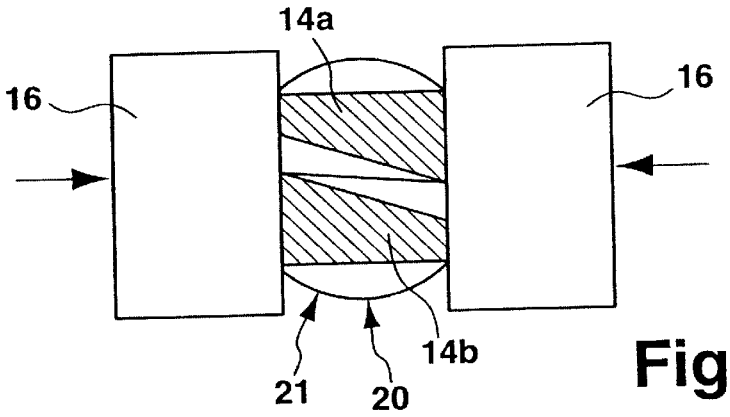
FIG. 3*c* shows a third phase for attachment of the end sections of the separation wall.
Figure 3D:
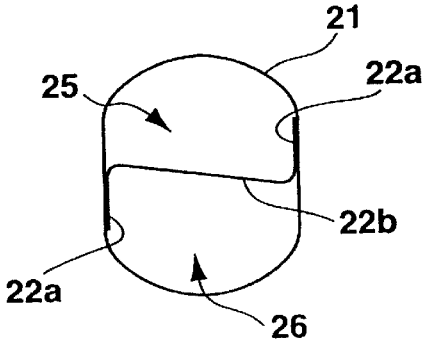
FIG. 3*d* shows a fourth phase for attachment of the end sections of the separation wall.

As shown in FIG. 3*c*, the pressing jaws are driven against the shaping head 14 from the outer side of the tube 20 so that the inner sides of the tube wall 21 seat over a large area at the end regions 22*a* of the separation wall 22, warmed with the assistance of the shaping head 14. The components are held in this welding or connecting position for a predetermined length of time to effect surface welding of the end regions 22*a* of the separation wall 22 to the wall of the tube 21. After the pressing jaws 16 have been retracted and the shaping head 14 removed from the inner region of the tube, the situation shown in FIG. 3*d* is obtained in which the end regions 22*a* of the separation wall 22 are connected over a large area to the tube wall 21 with the middle region 22*b* extending substantially linearly and diametrically through the inner region of the tube 20. The tube 20 has received a small deformation in response to the attachment process which however is not disadvantageous to the subsequent filling procedure.

We claim:

1. A method for filling a two-chamber tube made from plastic and having a substantially circular cross section, the tube having a separation wall made from flexible plastic which extends between two substantially diametrically opposed connecting points of a tube wall, the separation wall forming, together with the tube wall, the two chambers of the tube, the method comprising the steps of:

a) surface welding only upper portions of end regions of the separation wall, bordering the connection points, to inner sides of the tube wall over large areas wherein, prior to welding, a separation wall length extending between the connection points exceed a diameter of the tube and subsequent to welding, a length of a middle region of the separation wall extending between said end regions is substantially equal to a diameter of the tube;

b) inserting a filling nozzle into each of the two chambers;

c) filling the chambers;

d) removing the filling nozzles, and e) sealing the tube.

2. The method of claim 1, wherein step a) comprises the step of fixing the end regions to the tube wall in a detachable fashion.

3. A method for filling a two-chamber tube made from plastic and having a substantially circular cross-section, the tube having a separation wall made from flexible plastic which extends between two substantially diametrically opposed connecting points of the tube wall, the separation wall forming, together with the tube wall, the two chambers of the tube, the method comprising the steps of:

a) surface welding end regions of the separation wall, which border the connection points, to inner sides of the tube wall over large areas, wherein, prior to welding, a separation wall length extending between the connection points exceeds a diameter of the tube and, subsequent to welding, a length of a middle region of the separation wall extending between said end regions is substantially equal to a diameter of the tube, wherein, for welding, a heated shaping head is introduced into the tube to hold said end regions of the separation wall in an aligned fashion and pressing jaws are driven from an outer side of the tube against sections of the shaping head holding the end regions to weld only upper portions of said end regions to said inner side of said tube;

b) inserting a filling nozzle into each of the two chambers;

c) filling the chambers;

d) removing the filling nozzles; and e) sealing the tube.

4. The method of claim 3, wherein the shaping head accepts the middle region of the separation wall within a groove substantially without contact.

5. The method of claim 3, wherein the pressing jaws are neither heated nor cooled.

6. An apparatus for filling a two chamber tube made from plastic, the tube having a substantially circular cross section and with a plastic separation wall extending between two substantially diametrically opposed connecting points of a tube wall, the separation wall having a length in excess of a diameter of the tube, the separation wall forming, together with the tube wall, the two chambers of the tube, the apparatus comprising:

a shaping unit having a heated shaping head for introduction into the tube to hold the end regions of the separation wall in an aligned fashion at seating surfaces of said shaping head, the shaping unit having pressing jaws disposed outside the tube, the pressing jaws driven towards said seating surfaces of said shaping head to attach the separation wall to inner sides of the tube wall, wherein a length of a middle region of the separation wall extending between end regions thereof is substantially equal to a diameter of the tube;

a filling unit disposed downstream of said shaping unit to fill the tube; and a sealing unit disposed downstream of said filling unit for sealing the filled tube.

7. The apparatus of claim 6, wherein said seating surfaces are formed on opposite sides of said shaping head.

8. The apparatus of claim 7, wherein said shaping head has a groove extending between said seating surfaces to subdivide said shaping head into two introduction sections.

9. The apparatus of claim 6, wherein said pressing jaws are neither heated nor cooled.

10. The apparatus of claim 8, wherein said groove has recesses on each of groove sides in a central region of said groove.

11. The apparatus of claim 8, wherein said introduction sections each have guiding surfaces on introductory sides thereof facing the tube.

12. The apparatus of claim 11, wherein said guiding surfaces are tilted with respect to each other such that the introduction sections have a tapered shape.

13. The apparatus of claim 8, wherein said groove extends diagonally with respect to said seating surfaces.

* * * * *